US005760672A

United States Patent [19]

Wang

[11] Patent Number: 5,760,672

[45] Date of Patent: Jun. 2, 1998

[54] SAFETY SWITCH BUILT-IN WITH PROTECTING CIRCUIT

[76] Inventor: Ming-Shan Wang, No. 5, Alley 4, Lane 108, Tung Hsing St., Nanking District, Taipei City, Taiwan

[21] Appl. No.: 850,722

[22] Filed: May 2, 1997

[51] Int. Cl.[6] ..... H01H 71/16; H01H 71/04

[52] U.S. Cl. ..... 337/79; 337/66; 337/68; 337/72

[58] Field of Search ..... 337/1, 3, 12–14, 337/16, 36, 37, 53, 59, 62, 66, 68, 72, 75, 79, 85, 89, 101, 111, 112, 113, 140

[56] References Cited

U.S. PATENT DOCUMENTS 5,539,371 7/1996 Yu ..... 337/66
5,694,106 12/1997 Wang ..... 337/79

*Primary Examiner*—Leo P. Picard
*Assistant Examiner*—Anatoly Vortman
*Attorney, Agent, or Firm*—Morton J. Rosenberg; David I. Klein; Jun Y. Lee

[57] ABSTRACT

A safety switch built-in with protecting circuit is provided. The safety switch includes a housing having a button shade pivotally mounted thereof. Three pairs of conductive plates is provided and one of the conductive plates is provided with a first platinum conductive boss. The other conductive plate is provided with a alloy plate having a second platinum conductive boss corresponding to the first conductive boss. A push and pull rod having one end being movably passed through an opening and the other end is pivotally connected with the button shade. Characterized in that wherein the alloy plate is made from assembling instead of pressing process. The curvature is formed such that the alloy plate is provided with bi-directional breaking functions. Furthermore, the internal stress structure will not be damaged during the assembling process. Besides, the yield and accuracy of mitering an overload current can be readily attained via the formula of V=IR and W=VA. Furthermore, the alloy plate is provided with a upper and lower supporting rods centrally such that the alloy plate is supported in a seesaw status. A push and pull rod is disposed in an opening of a free end and is connected to the supporting rods. Then push and pull rod has a jumping space (ΔS) such that the alloy plate can be actuated in a recessed or projected position to attain an closed and opened circuits respectively. The configuration is therefore simplified and the manufacturing cost can be reduced. Wherein when the push and pull rod and/or button is jammed or malfunctioned, the jumping space (ΔS) is designed such that the alloy plate is deformed and the opened circuit can be still attained and kept. The safety can be therefore ensured.

1 Claim, 11 Drawing Sheets

ON

OFF

SAFETY SWITCH BUILT-IN WITH PROTECTING CIRCUIT

FIELD OF THE INVENTION

The present invention relates to a safety switch having a protecting circuit built-in thereof. This safety switch can be readily switched between two positions without the help of an additional spring member. The safety switch is opened in case of overload. Consequently, the safety of the user can be therefore ensured.

DESCRIPTION OF PRIOR ART

The conventional wall-mounted see-saw switch is usually used to control the On/Off of a light and which generally includes a button 11 capable of being positioned in two different positions as an exerted force is applied at one end for establishing a closed or opened circuit via a retaining tab 110 which butts against a plate 12. However, this see-saw switch must be operated manually such that the closed or opened circuit can be attained once the button is pressed at one end. Unless the button is pressed at one end, otherwise the see-saw switch will remain in a preset position, i.e. opened circuit is remained in opened position; and closed circuit is remained in closed position. This see-saw switch can not be switched from the closed position to an opened position even an overload is encountered. If the supplied power can not be interrupted immediately, the electric conductive wires will become more and more hot, eventually, a risk of getting a fire can be encountered. In light of this, the safety and property of user can not be suitably protected.

U.S. Pat. No. 5,262,748, entitled to "Fuseless Breaking Switch", hereinafter referred to as '748, has disclosed a subject matter which is intended to solve the defects of the conventional see-saw switch. This Fuseless breaking switch comprises a casing 1 having a button 21 pivotally mounted thereof. The bottom of the casing 1 is further provided with two sets of prongs 3, 3'. One set of the prongs 3 is disposed with a plate 25 having a platinum conductive protrusion 251 thereof. One end of the plate 25 is disposed above the corresponding prongs 3' and is electrically connectable with the conductive protrusion 31 of the prongs 3'. The button 2 is further provided with a rod 23 and which is in turn connected to the plate 25. When the button 21 is depressed, the prongs 3, 3' is electrically connected via the plate 25 and the platinum conductive protrusion 251. When an overload is experienced, the plate 25 is heated such that the plate 25 experiences a deformation such that the electrical engagement with said platinum conductive protrusion 31 is disconnected. Consequently, the supplied power is interrupted. The safety and property of user are therefore ensured.

Even the disclosure of '748 provides an improved breaking switch to solve the problem encountered by a see-saw switch, it can be still concluded with the following defects.

1. When the button 21 is depressed or jammed, or the spring blade 24 experiences a fatigue, the conductive protrusion 251 will not be disconnected even an overload is encountered. The breaking switch itself will be melt by the increasing heat. The potential risk of getting fire can not be suitable avoided. 2. The operating principle of the breaking switch is based on when the plate 25 made from alloy is heated during an overload, the deformation of the alloy plate 25 resulted from increasing heat will cause the plate 25 to deform. Normally, the breaking temperature is set between 100–150 degrees Celsius. In this case, the deformation will be larger than the spring blade 24 such that the breaking switch is actuated to opened circuit. In this case, even the button 21 is depressed to On position, if the deformation of the alloy plate 25 is still larger than the spring blade 24, the engagement to the conductive protrusion 251 will be disconnected immediately after it is engaged. If the button 21 is kept in depressed position, even an engagement is attained between the conductive protrusions 251, 31, the plate 25 is functionless and the temperature is still increasing. On the other hand, the platinum conductive protrusions 251, 31 are contacted with each other, if the depressing force exerted thereon is not uniformly distributed, a spark will be experienced as resulted from load and poor contact. In this case, the platinum conductive protrusions 251 and 31 will be easily oxidized.

3. The alloy plate 25 has a planar configuration which can only be moved and deformed in one direction as experiencing increased heat. Accordingly, the spring blade 24 shall be incorporated such that the breaking switch may provide a two-directional breaking functions. The spring blade 24 is made from pressing metal sheet. The resilient rating of each spring blade 24 is difficult to set to an equal level, too strong or two weak. If the rating is too high, the alloy plate 25 can not be disconnected during the overload condition and potential risk of getting fire will be encountered. If the rating is two weak, the engagement between two adjacent platinum conductive protrusions are insufficient such that a spark will be encountered. This resulted spark will reduce the service life of the platinum conductive protrusions 251 and 31.

U.S. Pat. No. 3,846,729, entitled to "Current Limiter", hereinafter referred to '729, has also provided a suggestion to solve the problem of overload. However, only a spring is incorporated and which can not effectively attain its intended purpose.

FIG. 3 has disclosed a conventional design of alloy plate 7'. This alloy plate 7' is made from directly pressed and a projected boss is formed in the central portion. When the alloy plate 7' is heated as the current flows through, the projected boss will be transferred into a recessed position, i.e. an opened circuit, as shown in phantom line. However, manufacturing of this conventional alloy plate 7' has a poor yield since the internal structure of this disk-shape alloy plate 7' has been damaged.

SUMMARY OF THE INVENTION

It is the objective of this invention to provide a safety switch built-in with protecting circuit wherein the alloy plate is made from assembling instead of pressing process. The curvature is formed such that the alloy plate is provided with bi-directional breaking functions. Furthermore, the internal stress structure will not be damaged during the assembling process. Besides, the yield and accuracy of mitering an overload current can be readily attained via the formula of V=IR and W=VA.

It is still the objective of this invention to provide a safety switch built-in with a protecting circuit wherein the alloy plate is provided with a upper and lower supporting rods centrally such that the alloy plate is supported in a seesaw status. A push and pull rod is disposed in an opening of a free end and is connected to the supporting rods. Then push and pull rod has a jumping space ($\Delta S$) such that the alloy plate can be actuated in a recessed or projected position to attain an closed and opened circuits respectively. The configuration is therefore simplified and the manufacturing cost can be reduced.

It is still the objective of this invention to provide a safety switch built-in with a protecting circuit wherein when the push and pull rod and/or button is jammed or malfunctioned, the jumping space (ΔS) is designed such that the alloy plate is deformed and the opened circuit can be still attained and kept. The safety can be therefore ensured.

It is still the objective of this invention to provide a safety switch built-in with a protecting circuit wherein a plurality of variants of safety switch can be readily assembled as benefited from the simplified components. Accordingly, the safety can be applied for different applications.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 4:
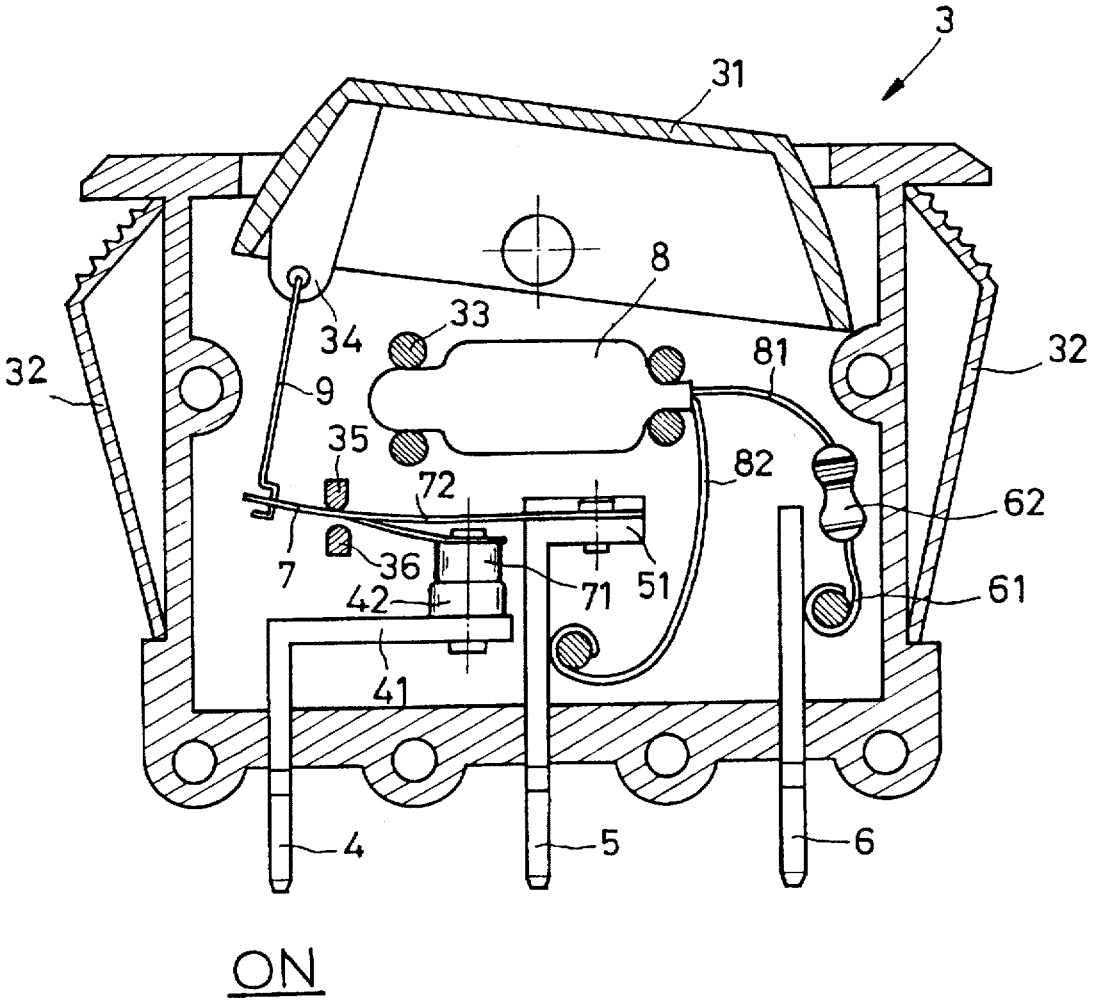
FIG. 4 is a schematic illustration of the safety switch made according to the present invention in closed circuit.
Figure 5:
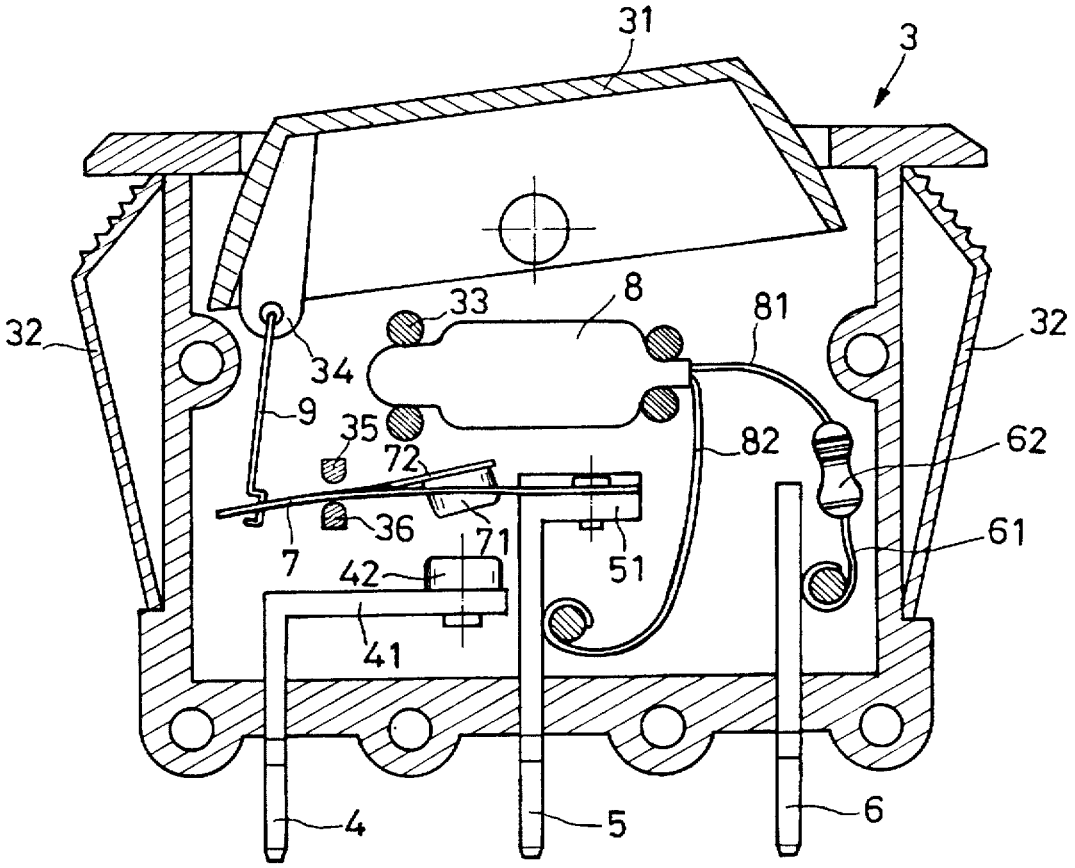
FIG. 5 is a schematic illustration of the safety switch shown in FIG. 4 in opened circuit.
Figure 9:
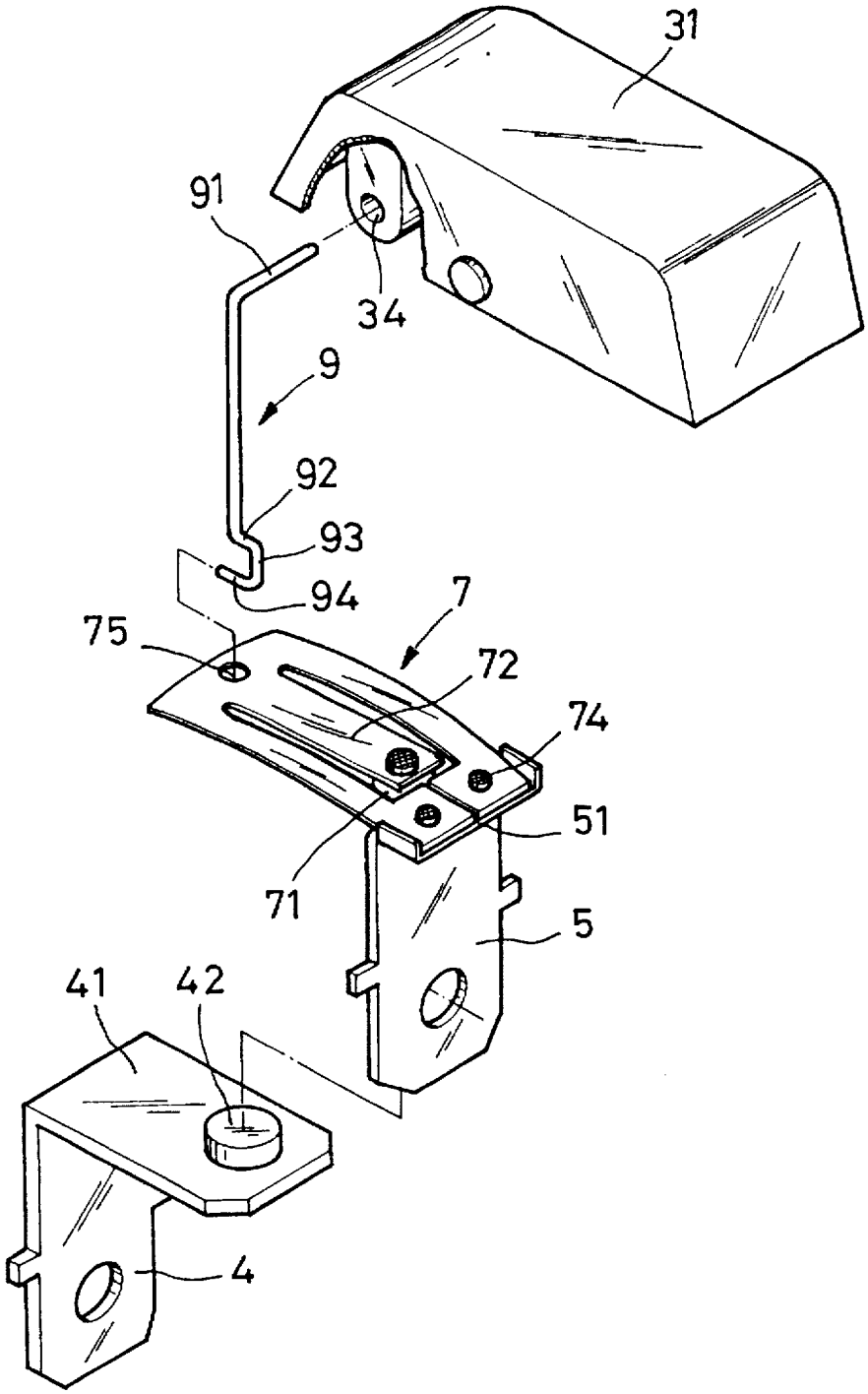
FIG. 9 is an exploded perspective view of the safety switch.

Referring to FIGS. 4 and 9, the safety switch made according to the present invention generally comprises a rectangular housing 3 having been provided with a left and right resilient hookers 32 at both sides respectively. A button shade 31 is pivotally disposed at top of the housing 3.

The safety switch is provided with three pair of conductive plates 4, 5 and 6 wherein the electric wires (not shown) are connected to the first and third conductive plates 4 and 6. The first conductive plate 4 is provided with a bending portion 41 having a platinum conductive boss 42 thereof. The second conductive plate 5 is provided with a alloy plate 7 having being provided with a platinum conductive boss 71 corresponding to the platinum conductive boss 42 of the first conductive plate 4. The third conductive plate 6 is connected to a resistance 62 via a conductive lines 61.

A neon light 8 is disposed under the button shade 31 and which is positioned via a plurality of projecting posts 33 disposed within the housing 3. A pair of conductive lines 81, 82 are respectively connected to the resistance 62 and the second conductive plate 5. When the first and second conductive plates 4 and 5 are powered, the neon light 8 is turned on to indicate the status of closed circuit.

A push and pull rod 9 having a traverse bending 91 is pivotally attached to the button shade 31 via a lug 34 disposed therein. The lower end of the push and pull rod 9 can be used to push and pull the free end of the alloy plate 7.

Figure 6A:
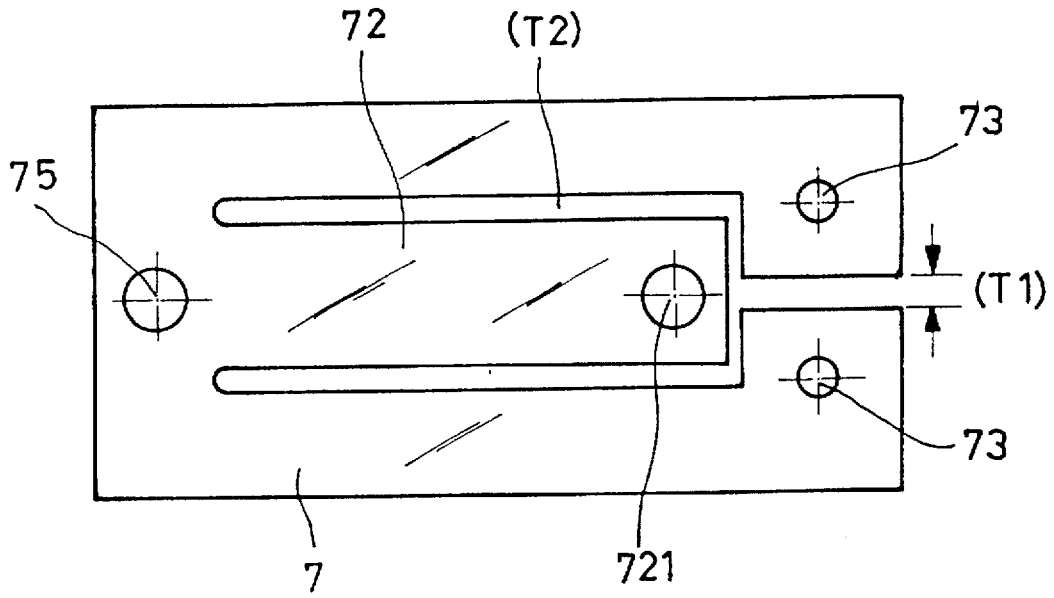
FIGS. 6A and 6B are plan views showing the alloy plate incorporated in the safety switch.
Figure 6B:
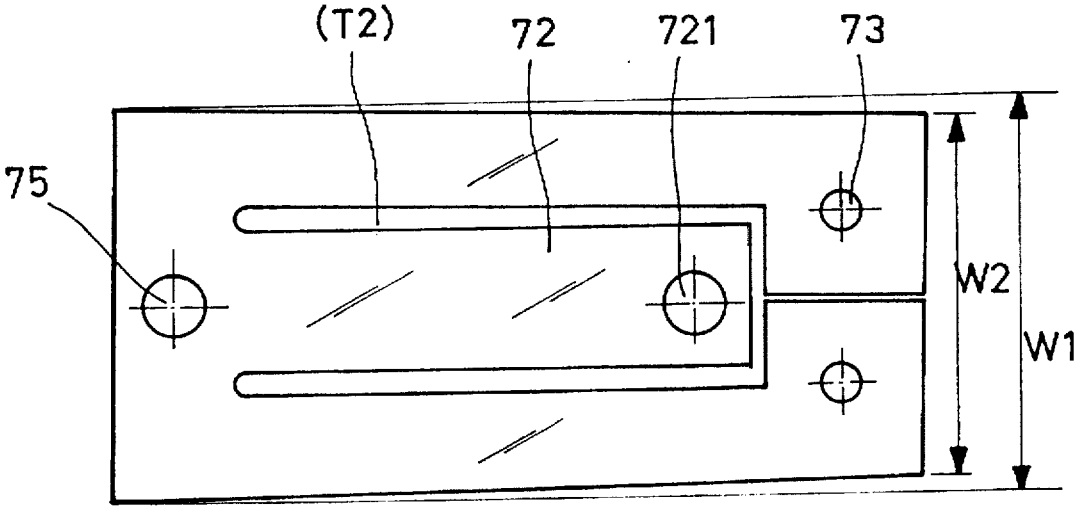
Figure 7:
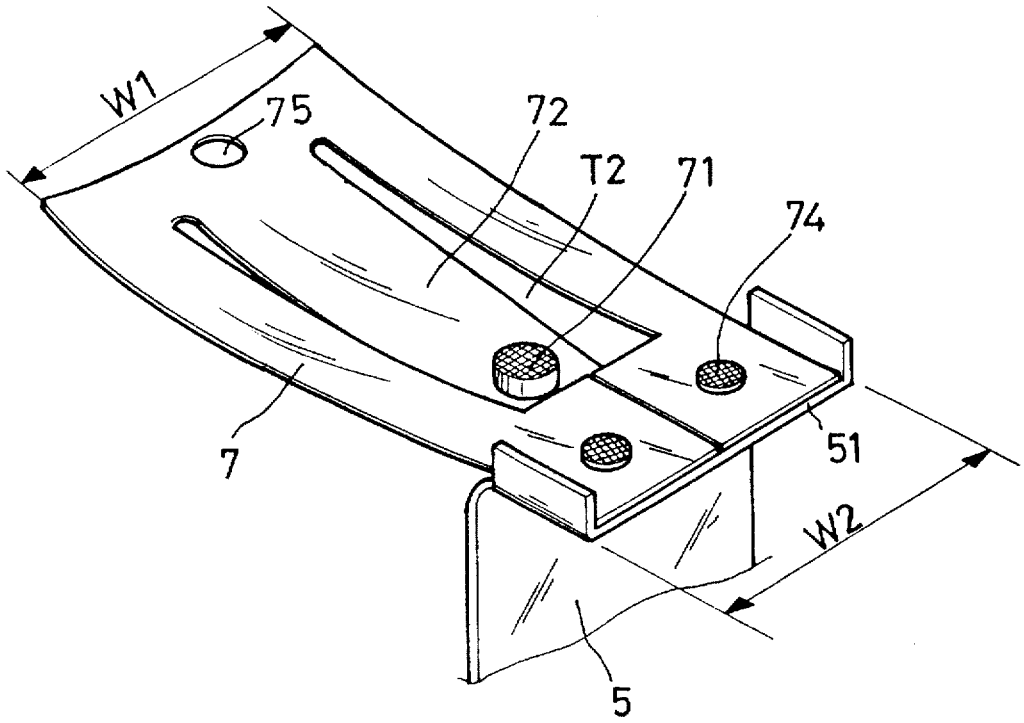
FIG. 7 is a perspective view of the alloy plate in closed circuit position.
Figure 8:
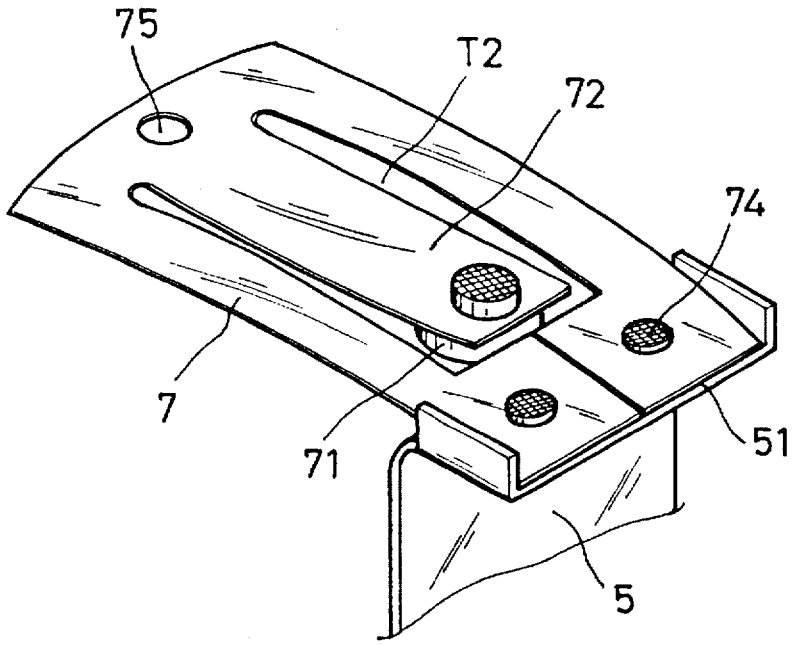
FIG. 8 is a perspective view of the alloy plate in opened circuit position.

Characterized in that the alloy plate 7 is extended with a contacting plate 72 at the free end centrally, as clearly shown in FIGS. 6A and 6B. The contacting plate 72 is provided with an opening 721 at the tail portion thereof for positioning the platinum conductive boss 71. The positioning end is provided with a slit T1 centrally and which is provided with a pair of positioning holes 73 at both sides along the slit T1. As clearly shown in FIG. 6B, the positioning end is then moved close to the slit T1 such that the original width W1 is narrowed to new width W2. By this arrangement, the alloy plate 7 has a wider free end while has a comparative narrow positioning end. The alloy plate 7 is attached to the bending portion 51 of the second conductive plate 5 via a rivet 74 and the positioning hole 73. The alloy plate 7 is made from a thin metal sheet and the contacting plate 72 disposed centrally is provided with a slit T2 in both side and tail portions. When the alloy plate 7 is shrunk to the narrower width W2 at its positioning end, a curvature will be naturally formed by its internal stress. Accordingly, the curvature can be formed naturally instead of forming a convex contacting plate with conventional pressing process. Since no mechanic force is applied to the alloy plate 7, no internal stress is constrained within the alloy plate, accordingly, the deforming curvature resulted from temperature rising as electric current flows through it will be remained unchanged. On the other hand, the ratio between the width W1 of free end and the width W2 of positioning end can be specially arranged such that the alloy plate 7 can be provided with bi-directional switching functions, as shown in FIG. 7, it can be transformed into a concave shape. When the alloy plate 7 is transformed into a concave shape, the contacting plate 72 is automatically extended downward according to principle of force. To the contrary, when the alloy plate 7 is transformed into a convex shape, the contacting plate 72 is extended upward such that the platinum conductive boss 71 at tail portion thereof is accordingly moved upward. The free end of the alloy plate 7 is further provided with an opening 75.

The push and pull rod 9 is firstly bent at the lower end to form a pushing part 92 thereof. Then the rod 9 is further bent to form a upright part 93. Then the rod 9 is further bent to form a horizontal pushing part 94 such that a jumping space (ΔS) is formed between the pushing part 92 and the pulling part 94. The lower end of the rod 9 is movably inserted with the opening 75 of the alloy plate 7 since the inner diameter of the opening 75 is slightly larger than the outer diameter of the rod 9. Accordingly, the free end of the alloy plate 7 is provided with a jumping space (ΔS) at the upright part 93.

Figures 10, 11:
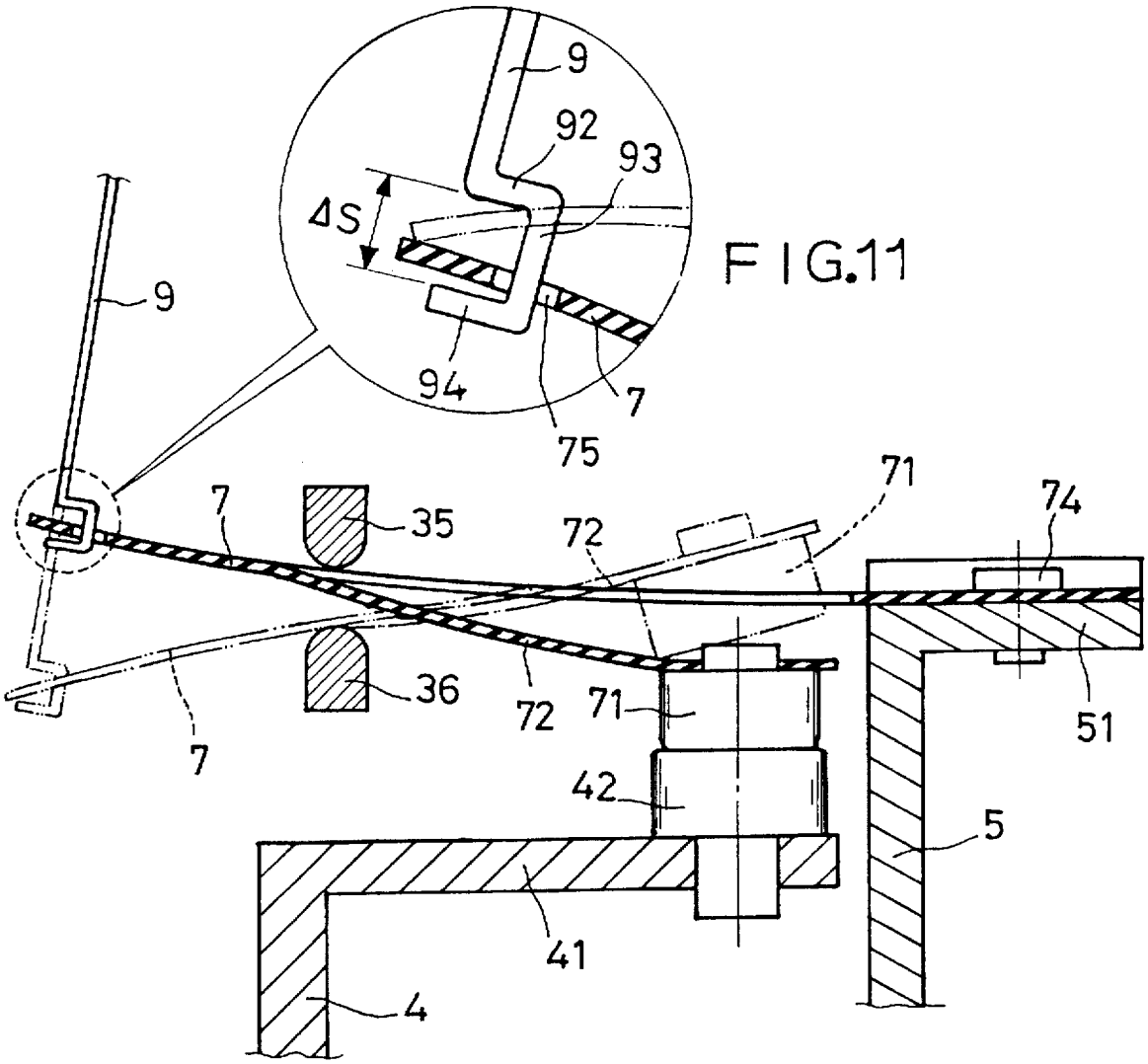
FIG. 10 is an assembled view of the safety switch.
FIG. 11 is an enlarged view of the circled part shown in FIG. 10.

The housing 3 is provided with an upper and lower supporting rods 35 and 36 in a position corresponding to the alloy plate 7 in the curvature changing portion. The upper and lower supporting rods 35, 36 are spaced from the alloy plate 7, as shown in FIGS. 4 and 10.

By this arrangement, when the electric current flows through the alloy plate 7, the alloy plate 7 will be automatically deformed in the contrary position such that the contacting plate 72 is disconnected and the system is kept in opened circuit to ensure the safety.

The operation of the present invention will be detailedly described as follow.

Again referring to FIGS. 4 and 10, when the button shade 31 is depressed at its right end, the free end of the alloy plate 7 is moved upward by the pulling part 94 disposed thereunder. When the alloy plate 7 is moved upward and furthermore, it will immediately be triggered into a concave shape as it butts against the upper supporting rod 35. Then the contacting plate 72 is bounced downward such that the platinum conductive boss 71 is electrically engaged with the platinum conductive boss 42 of the first conductive plate 4. As a result, the neon light 8 is illuminated to indicate a closed circuit status.

When the button shade 31 is depressed toward the left end, the free end of the alloy plate 7 is pushed downward by the horizontal pushing part 92 of the rod 9. When the alloy plate 7 is moved downward and touches the lower supporting rod 36, the alloy plate 7 is transformed into a convex shape such that the contacting plate 72 is bounced upward. In this case, the electrical engagement between the platinum conductive boss 71 will be disconnected from the platinum conductive boss 42 of the first conductive plate 4, consequently, the neon light 8 is turned off and the system resumes to an opened status.

The alloy plate 7 is forged from two different metal and the heat expansion coefficient between two metals are different. The metal has an inherited resistance, with the principles of V=IR and W=VA, the alloy plate 7 can be designed such that a closed circuit is kept in room temperature while the alloy plate 7 is in concave shape. However, when the electrical current flows therethrough exceeds the rating, the rising temperature will cause the metal to expand such that the curvature will be changed accordingly. Then the system can be switched to an opened circuit. The working principle of alloy plate 7 has been detailedly described in prior art, no further description will be given.

By the subtle corporation of the alloy plate 7 having been specially designed to transform between a concave and convex positions and the push and pull rod 9 and the upper and lower supporting rods 35 and 36, the conventional disadvantages can be completely solved. As a detailed description to the alloy plate 7 has been given, not further description is given below. Referring to FIGS. 9, 10 and 11, when excess electric current flows over the alloy plate 7, the alloy plate 7 will be transformed from a concave shape into a convex shape such that the contacting plate 72 is bounced upward such that the platinum conductive bosses 71 and 42 are disconnected. Since the curvature of the alloy plate 7 is automatically formed by closing one end, no mechanic stress is constrained within the alloy plate 7. Accordingly, the rating preset to the alloy plate 7 can be accurately set and kept. When the temperature exceeds the threshold, the alloy plate 7 will be automatically triggered such that the system is set to an opened circuit status. Most important, if the alloy plate 7 is jammed resulted from a malfunctioned button shade 31 or the push and pull rod 9, the alloy plate 7 can still be moved a little such that the opened circuit can be attained to ensure the safety of the user.

In order to achieve the preset functions, the alloy plate 7 is independent from the push and pull rod 9. i.e. not substantial engagement or connection is set therebetween. The pulling part 94 of the push and pull rod 9 is firstly passing through the opening 75 of the alloy plate 7, then the upright part 93 is set to be disposed within the opening 75. By this arrangement, even the temperature has raised to the preset temperature, there is still a jumping space (ΔS) between the pushing part 92 and the pulling part 94.

Figure 12:
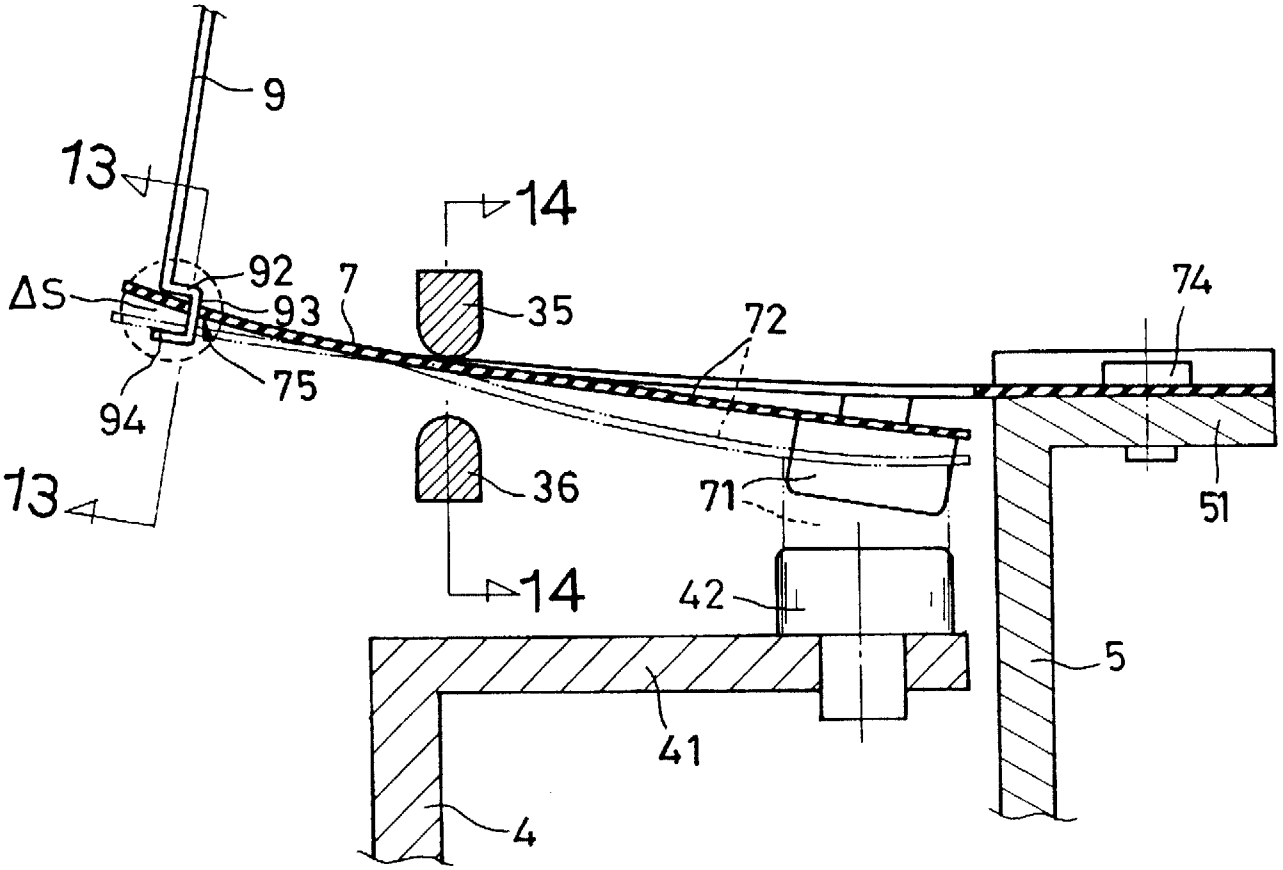
FIG. 12 is a schematic illustration showing the alloy plate is disposed in semi-opened position.
Figure 13:
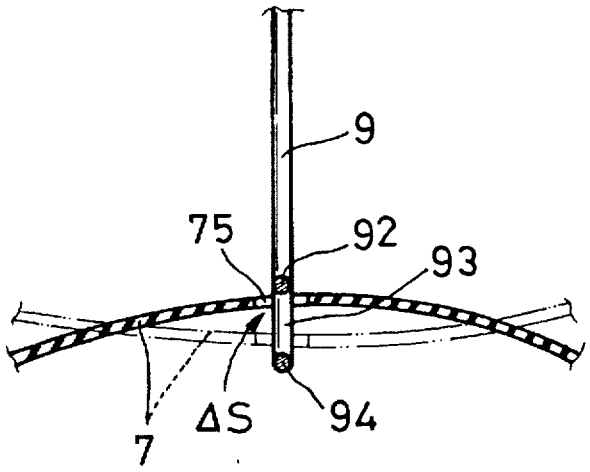
FIG. 13 is a cross sectional view taken from line 13—13 in FIG. 12.
Figure 14:
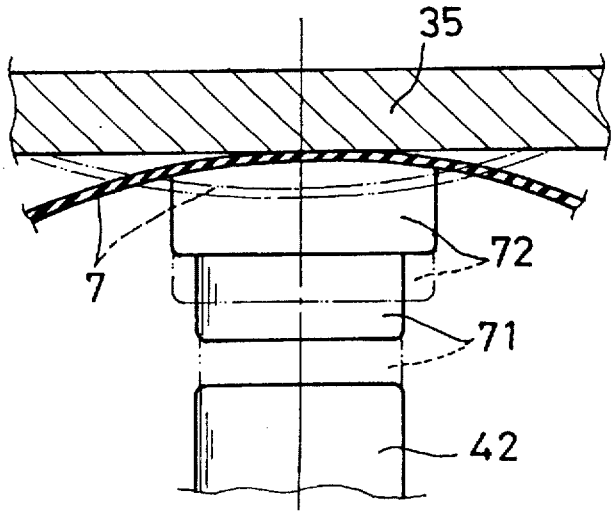
FIG. 14 is a cross sectional view taken from line 14—14 in FIG. 12.

Still referring to FIGS. 12, 13 and 14, when the system is set in closed circuit, the pull and push rod 9 is directed upward and the alloy plate 7 is pulled by the pulling part 94 at the lower end. Consequently, the alloy plate 9 can be transformed into a concave shape longitudinally and traverse as shown in phantom lines. Then, the platinum boss 72 is extended downward to engage with the platinum conductive boss 42, i.e. a closed circuit is attained.

Figure 1:
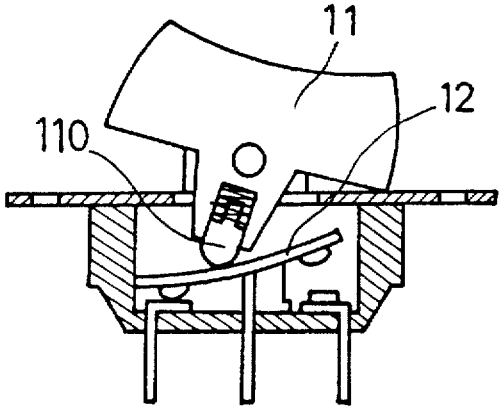
PRIOR ART FIG. 1
FIG. 1 is schematic illustration showing the configuration of a conventional seesaw switch.
Figure 2A:
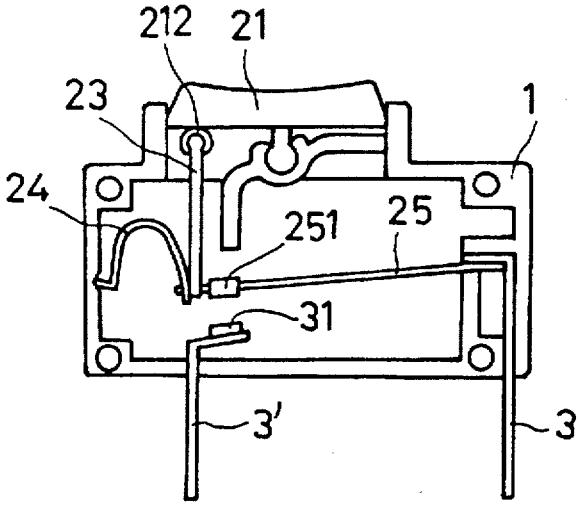
PRIOR ART FIG. 2A
FIGS. 2A and 2B disclose the breaking switch of U.S. Pat. 5,262,748.
Figure 2B:
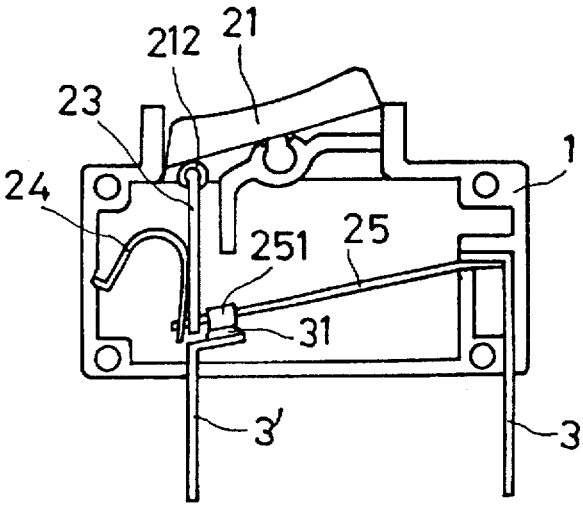
PRIOR ART FIG. 2B
Figure 3:
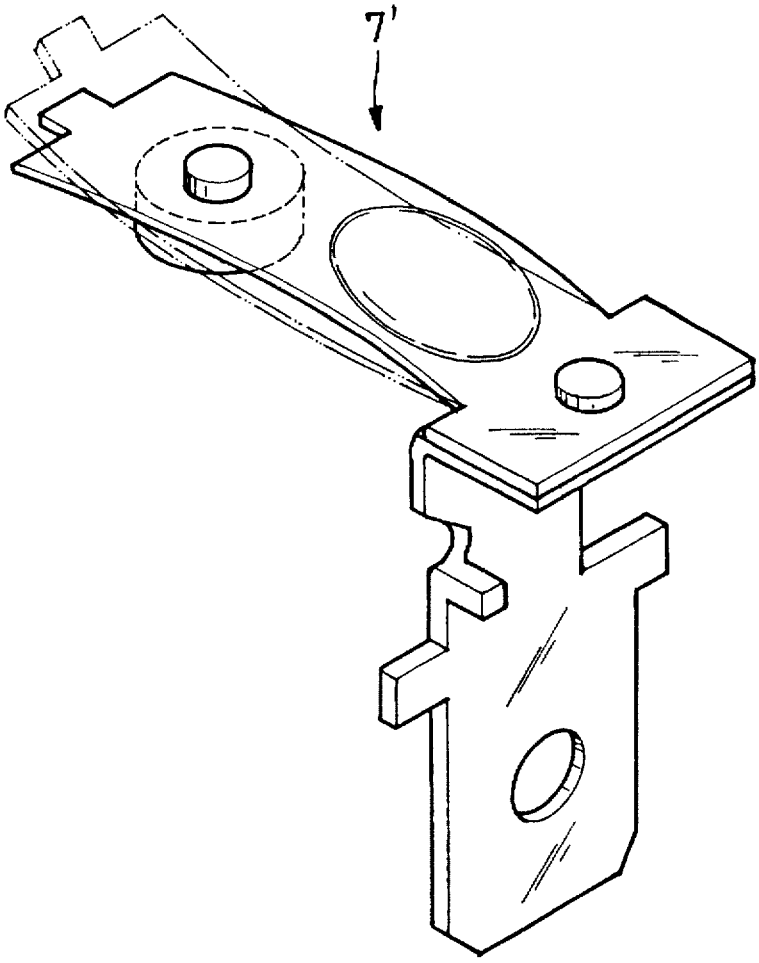
PRIOR ART FIG. 3
FIG. 3 is a perspective view of a conventional alloy plate.

When the button shade 31 or the push and pull rod 9 are malfunctioned, and the alloy plate 7 can not be moved downward normally, as the free end of the alloy plate 7 is not fixed, by the provision of the jumping space (ΔS), the alloy plate 7 may still be moved longitudinally to change the surface curvature, changing from concave into convex shapes. Once the alloy plate 7 is transformed from concave into convex, the platinum conductive bosses 71 and 42 will be disconnected from each other to establish an opened circuit to ensure a safety. The above described function is far reached by the conventional art shown in FIG. 2.

Figure 15A:
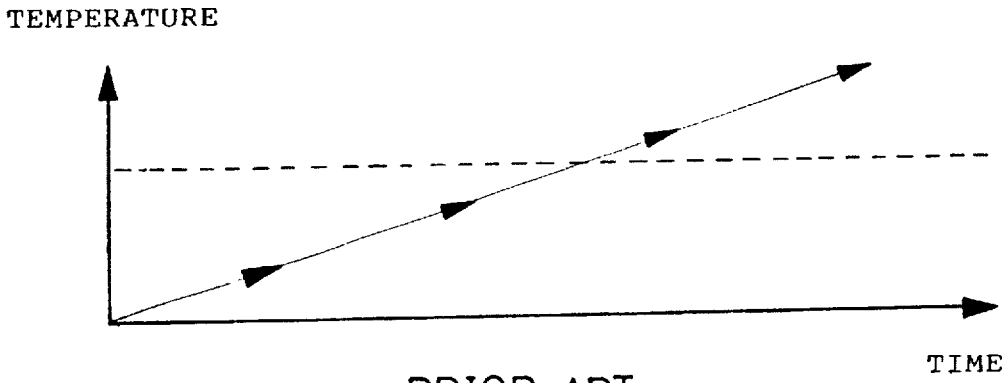
PRIOR ART FIG.15(A)
FIG. 15 is a comparative chart showing the temperature rising of the present invention and conventional switch.
Figure 15B:
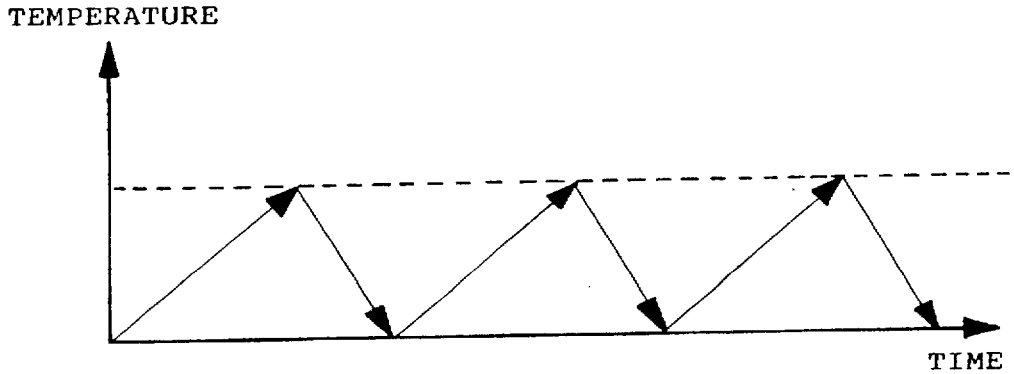
PRIOR ART FIG.15(B)

FIG. 15A is a temperature rising chart of U.S. Pat No. 5,262,748. When the switch is malfunctioned and that the contacting plate 25 can not be disconnected, the temperature will keep on rising till the whole housing is burned down. In the conventional breaking switch, the contacting plate will be disconnected when the temperature exceeds a threshold. However, the contacting plate will resumes connecting when the temperature lowers down. As shown in FIG. 15B, the temperatures varies up and down repeatedly. Even the safety can be ensured, the repetitive interrupt of power supply brings negative influence to the appliance.

Figure 15C:
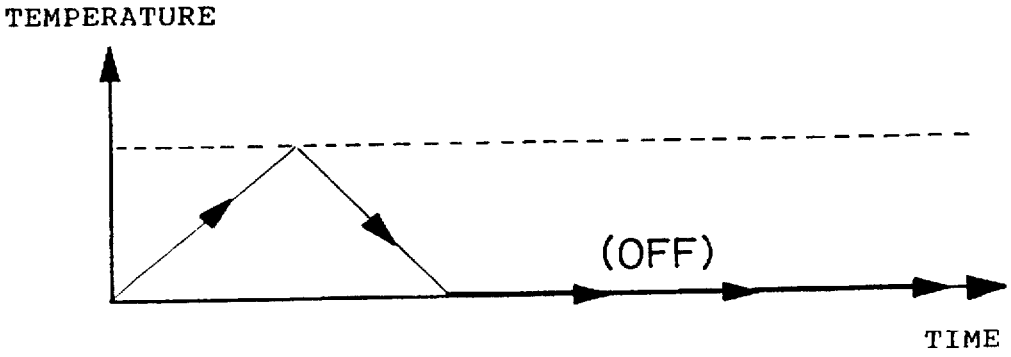

As shown in FIGS. 12 and 14, when the contacting plate 72 of the alloy plate 7 is disconnected as the temperature exceeds the threshold, the alloy plate 7 does not deform along its traverse direction, however, the alloy plate 7 has transformed into a convex shape longitudinally and the curvature has exceeded the horizontal line. Accordingly, even the temperature lowers down, the alloy plate will not resume to its original shape. Accordingly, when a malfunctioned is experienced during the operation of the switch, the contacting plate 72 will be disconnected automatically when the temperature exceeds the threshold. Only when the potential reason has been checked and solved, the switch can resume to normal operation, otherwise, the switch will be kept in opened circuit status. The temperature rising is shown in FIG. 15C. By the comparison of the charts shown respectively in FIGS. 15A, 15B and 15C, the present invention provides clear and instant interrupt of power supply and only when the malfunction is overcome, the switch may resumes to function. The defects resulted from repetitive power on/off of conventional switch can therefore be completely overcome.

While particular embodiment of the present invention has been illustrated and described, it would be obvious to those skilled in the art that various other changes and modifications can be made without departing from the spirit and scope of the invention, for example, the housing 3 can be integrally formed with a socket for a specially application. It is therefore intended to cover in the appended claims all such changes and modifications that are within the scope of the present invention.

I claim:

1. A safety switch built-in protecting circuit, comprising a rectangular housing having been provided with a left and right resilient hookers at both sides respectively, a button shade being pivotally mounted thereof;

three pair of conductive plates being provided and wherein an electric wires are connected to the first and third conductive plates, said first conductive plate being provided with a bending portion having a platinum conductive boss thereof, said second conductive plate being provided with a alloy plate having being provided with a platinum conductive boss corresponding to said platinum conductive boss of said first conductive plate, said third conductive plate being connected to a resistance via a conductive lines;

a neon light being disposed under said button shade and which is positioned via a plurality of projecting posts disposed within said housing, a pair of conductive lines being respectively connected to said resistance and said second conductive plate, wherein when said first and second conductive plates are powered, said neon light is turned on to indicate a status of closed circuit; and a push and pull rod having a traverse bending being pivotally attached to said button shade via a lug disposed therein, the boozer end of said push and pull rod being used to push and pull the free end of said disk-shape alloy plate;

characterized in that said alloy plate is extended with a contacting plate at the free end centrally, said contacting plate being provided with an opening at the tail portion thereof for positioning said platinum conductive boss of said alloy plate, said positioning end being provided with a slit (T1) centrally and which is provided with a pair of positioning holes (73) at both sides along said slit (T1), wherein said positioning end can be moved close to said slit (T1) such that said disk-shape alloy plate has a wider free end while has a comparative narrow positioning end and no further spring member is required since said alloy plate is provided with a natural curvature, the free end of said alloy plate 7 being further provided with an opening;

said push and pull rod being firstly bent at the lower end to form a pushing part thereof said rod being further bent to form a upright part and a horizontal pushing part such that a jumping space ($\Delta S$) is formed between said pushing part and said pulling part, the lower end of said rod being movably inserted with said opening of said alloy plate since the inner diameter of said opening is slightly larger than the outer diameter of said rod, wherein the free end of said alloy plate is provided with a jumping space ($\Delta S$) at said upright part;

said housing being provided with an upper and lower supporting rods in a position corresponding to said alloy plate in the curvature changing portion, said upper and lower supporting rods being spaced from said alloy plate;

by this arrangement, under the room temperature, said disk-shape alloy plate can be suitably pushed or pulled to switch from a concave, a closed circuit, and a convex, an opened circuit normally, wherein when an overload is encountered and said push and pull rod is malfunctioned, said alloy plate can be immediately changed into a convex shape, a complete or semi-complete disconnected, to disconnected the engagement between said platinum conductive bosses, accordingly, a constant opened circuit can be attained to ensure the safety of user.

* * * * *